US006030067A

United States Patent [19]

Kawamura

[11] Patent Number: 6,030,067

[45] Date of Patent: Feb. 29, 2000

[54] INK JET PRINTER

[75] Inventor: Hiroki Kawamura, Nisshin, Japan

[73] Assignee: Brother Kogyo Kabushiki Kaisha, Nagoya, Japan

[21] Appl. No.: 08/974,884

[22] Filed: Nov. 20, 1997

[30] Foreign Application Priority Data

Nov. 21, 1996 [JP] Japan ..... 8-310777

[51] Int. Cl.[7] ..... B41J 23/00

[52] U.S. Cl. ..... 347/37

[58] Field of Search ..... 347/22, 23, 29, 347/30, 32, 33, 34, 37

[56] References Cited

U.S. PATENT DOCUMENTS

| | | | |
|---|---|---|---|
| 4,544,931 | 10/1985 | Watanabe et al. | 347/37 |
| 5,138,343 | 8/1992 | Aichi et al. | 347/30 |
| 5,140,344 | 8/1992 | Tsukada et al. | 347/37 |
| 5,692,842 | 12/1997 | Sasai et al. | 347/37 |
| 5,850,237 | 12/1998 | Slade | 347/23 |

FOREIGN PATENT DOCUMENTS

Y2 3-38515 8/1991 Japan .

*Primary Examiner*—N. Le
*Assistant Examiner*—Anh T. N. Vo
*Attorney, Agent, or Firm*—Oliff & Berridge, PLC

[57] ABSTRACT

An ink jet printer includes a print head, a carriage on which the head is mounted, and a maintenance mechanism for the head. The carriage can be moved along a guide bar by the driving system including a toothed driving pulley, a cylindrical driven pulley and a timing belt, which runs between the pulleys. The carriage is fixed to the belt. When the carriage moves, it pushes the lever for operating the maintenance mechanism. This applies a high load to the driving pulley. Part of the belt has teeth for meshing with the driving pulley when the carriage moves in the area where the high load is applied to this pulley. Consequently, the driving pulley does not slip on the belt.

22 Claims, 11 Drawing Sheets

INK JET PRINTER

BACKGROUND OF THE INVENTION

1. Field of the Invention

The present invention relates to an ink jet printer for printing a printing medium by ejecting droplets of ink onto it. In particular, the invention relates to an ink jet printer including a drive mechanism for moving a print head carriage without vibration of the head and splipping of a driving belt for the carriage.

2. Description of the Related Art

A certain ink jet printer or another printer includes a print head, a carriage on which the head is mounted, and a mechanism, for moving the carriage, which includes a pair of toothed synchronous pulleys and a toothed timing belt running between the pulleys. The carriage is connected to the belt. While the carriage is moved over a printing medium, the head prints the medium. The belt has teeth formed on its overall inner periphery. The pulleys are a driving pulley and a driven pulley, each of which has teeth formed on its overall outer periphery. When the teeth of the pulleys and belt mesh, their interference generates vibration, which prevents the belt from turning smoothly. Particularly in the case of an ink jet printer for high resolution printing, this vibration is transmitted through the carriage to the print head, and affects the printing quality.

Japanese Utility Model Publication No. H.3-38515 discloses a toothed driving pulley, a toothless driven pulley and a half toothed belt. The belt includes a flat half for engagement with the driven pulley. This prevents the belt and the driven pulley from interfering, and therefore suppresses the generation of vibration. Because the teeth of the driving pulley and the belt mesh, however, it is not possible to avoid the vibration generated by the interference of the teeth during printing.

It is possible to further suppress the vibration generation by making the driving pulley also toothless and the whole belt flat without any teeth. By the way, a certain ink jet printer takes advantage of the movement of its carriage to control its maintenance mechanism for sucking ink from the print head and/or capping the head. During this movement, the load on the carriage is so great that, if both pulleys and the whole belt are toothless, the belt may slip on the pulleys.

SUMMARY OF THE INVENTION

It is an object of the present invention to provide an ink jet printer for high quality printing with less vibration. It is another object of the invention to provide an ink jet printer including a maintenance mechanism which can be controlled with sufficient driving force without the timing belt slipping.

In accordance with a first aspect of the invention, an ink jet printer is provided, which includes a print head for ejecting droplets of ink onto a printing medium. The head is mounted on a carriage, which may be moved along a guide bar by a driving system. The system includes a toothed driving pulley, a cylindrical driven pulley and an endless belt being engaged on and between these pulleys. The carriage is fixed to the belt. Only part of the belt has teeth for meshing with the toothed pulley. When the carriage moves in different area between the toothed driving pulley and the cylindrical driven pulley, different loads are applied to the driving system. Only when the carriage moves in an area where a high load is applied to the driving system, the toothed pulley meshes with the belt teeth.

Thus, the teeth on the part of the belt of the carriage driving system mesh with the toothed pulley only when the carriage is in a predetermined area where a high load is applied to the driving system. Therefore, in spite of the high load, the pulley is prevented from slipping on the belt. The printer may also include a maintenance mechanism for at least one of the maintenance and recovery of the ink ejection operation of the print head. The printer may further include an operating system for operating the maintenance mechanism with the carriage driving force by engaging with the carriage. When the carriage engages with the operating system, a high load is applied to the driving system, and in particular to the driving pulley. Under such conditions, the belt is prevented from slipping, and the maintenance of the head is performed by the maintenance mechanism securely in a desired carriage position through the operation of the operating system.

When the carriage moves in the printing area where a printing medium is printed, a lower load may be applied to the driving system than when the carriage moves in the area where it engages with the operating system. Under such conditions, the toothed pulley engages with the toothless or flat part of the belt. This prevents vibration of the carriage and the print head which would be generated if the toothed pulley meshed with the belt teeth. Therefore, the printer can perform high quality printing.

In accordance with a second aspect of the invention, another ink jet printer is provided, which includes a print head for ejecting droplets of ink onto a printing medium. The printer also includes a maintenance mechanism for the maintenance and/or recovery of the ink ejection operation of the head. The head is mounted on a carriage, which can move in and between a printing area and a maintenance area, where the carriage faces the maintenance mechanism. An operating system may operate the maintenance mechanism with the carriage driving force by engaging with the carriage. A driving system for moving the carriage may include a toothed driving pulley, a cylindrical driven pulley and an endless belt, which runs between the pulleys. The carriage is fixed to the belt. Only part of the belt has teeth for meshing with the toothed pulley. The belt is in such engagement with the toothed pulley that, when the carriage engages with the operating system, the toothed pulley meshes with the belt teeth.

When the carriage of this printer engages with the operating system, a higher load is applied to the driving system than when the carriage moves in the printing area. As stated above, only part of the belt has teeth for meshing with the toothed pulley. As also stated, the belt is in such engagement with the toothed pulley that, when the carriage engages with the operating system, the toothed pulley meshes with the belt teeth. The engagement of the toothed pulley with the belt teeth transmits the driving force of the pulley securely through the belt to the carriage. Therefore, even if a high load is applied to the driving pulley, the pulley does not slip on the belt.

When the carriage of this printer is positioned in the printing area, the toothed pulley engages with the flat part of the belt. This prevents vibration of the print head which would be generated if the belt teeth meshed with the pulley teeth.

Japanese Utility Model Publication H.3-38515 discloses a toothed belt transmission device. The belt of the device includes a driven part for engagement with a toothed pulley. The driven part has teeth, and the other part of the belt is flat. If this device is applied to a printer, however, the belt teeth mesh with the toothed pulley when the print head is positioned in the printing area as well. By contrast, the belt teeth of the printer according to the second aspect of the invention mesh with the toothed pulley only when a high load is applied to the carriage driving system. The belt teeth do not mesh when the carriage is positioned in the printing area. Therefore, this printer can effectively utilize the carriage driving force to operate the operating system for the maintenance mechanism, and can achieve quiet high-quality printing.

The maintenance mechanism of each printer may include a suction device for sucking ink from the print head. The operating system for the maintenance mechanism may include a pair of driven levers, which can protrude into the path of the carriage in order to be pushed by the carriage. Each driven lever can pivot on an axis into and out of the path of the carriage. The levers may be linked together by a link so that, when one of the levers is tipped over from the path, the other lever is protruded into the path. The carriage may tip over one of the driven levers when the carriage enters a maintenance area, where it faces the maintenance mechanism. The carriage may tip over the other lever when the carriage leaves the maintenance area. With the driven levers thus arranged, it is possible to operate the maintenance mechanism by detecting the carriage movement into and out of the maintenance area.

The maintenance mechanism of the ink jet printer may also include a protective cap for closely contacting the print head in order to prevent the head nozzles from drying. The maintenance mechanism operating system may include another lever connected to the cap. This lever protrudes into the path of the carriage in order to be pushed by the carriage. The cap is urged away from the head, and can be moved by a cam toward the head when this lever is pushed to slide the cap together with the carriage.

The maintenance mechanism may includes both or one of the suction device and the protective cap. The maintenance mechanism may further include a wiper for wiping the nozzles of the print head.

Each printer may further include an encoder having indexes along the path of the carriage. A detector may be mounted on the carriage. The detector can read the indexes and generate a signal, which is the basis for controlling the position of the print head. Therefore, even if the driving pulley slips a little on the belt when the print head moves in the printing area, it is possible to control the head position and the ejection timing accurately or precisely by the detector reading the indexes.

BRIEF DESCRIPTION OF THE DRAWINGS

A preferred embodiment of the invention is shown in the accompanying drawings, in which.

DETAILED DESCRIPTION OF THE EMBODIMENT

Figure 1:
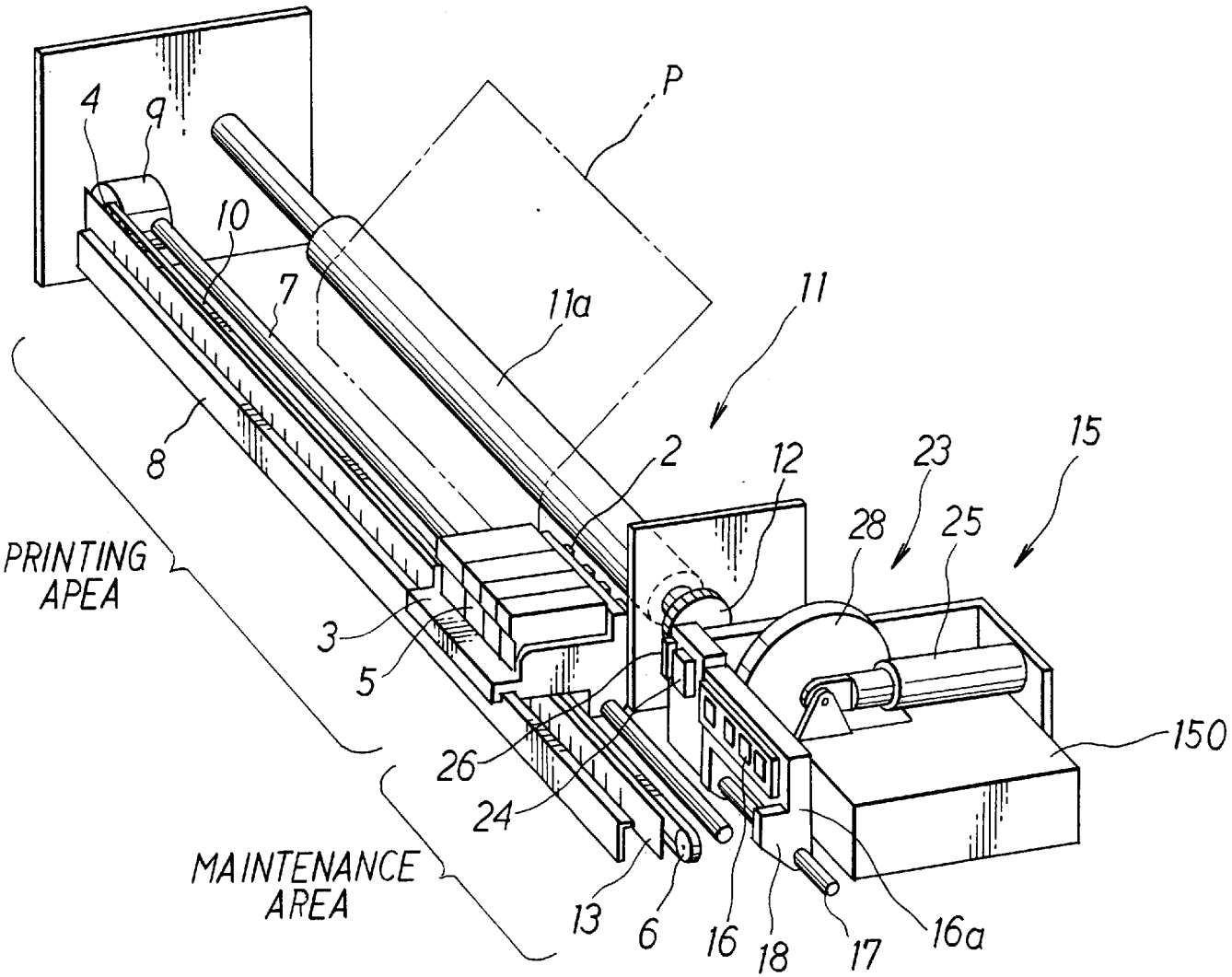
FIG. 1 is a perspective view showing the internal structure of an ink jet printer according to the embodiment.

With reference to FIG. 1, an ink jet printer according to the invention includes four ink jet print heads 2 for printing a sheet of paper P by each ejecting onto it an ink of one of four colors (cyanogen, magenta, yellow and black). The heads 2 are mounted on a carriage 3. Removably mounted on the carriage 3 are ink cartridges 5 for each supplying one of the heads 2 with an ink.

The carriage 3 is supported at its front and rear ends slidably on a pair of horizontally extending parallel guide bars 7 and 8, respectively. The carriage 3 can be reciprocated by the driving mechanism including a drive source, which is a carriage drive motor 9, a toothed driving pulley 4, which can be driven by the motor 9, a cylindrical or toothless driven pulley 6 and an endless belt 10, which runs between the pulleys. The carriage 3 is fixed to the belt 10, which can be turned to move it along the bars 7 and 8.

Figure 2:
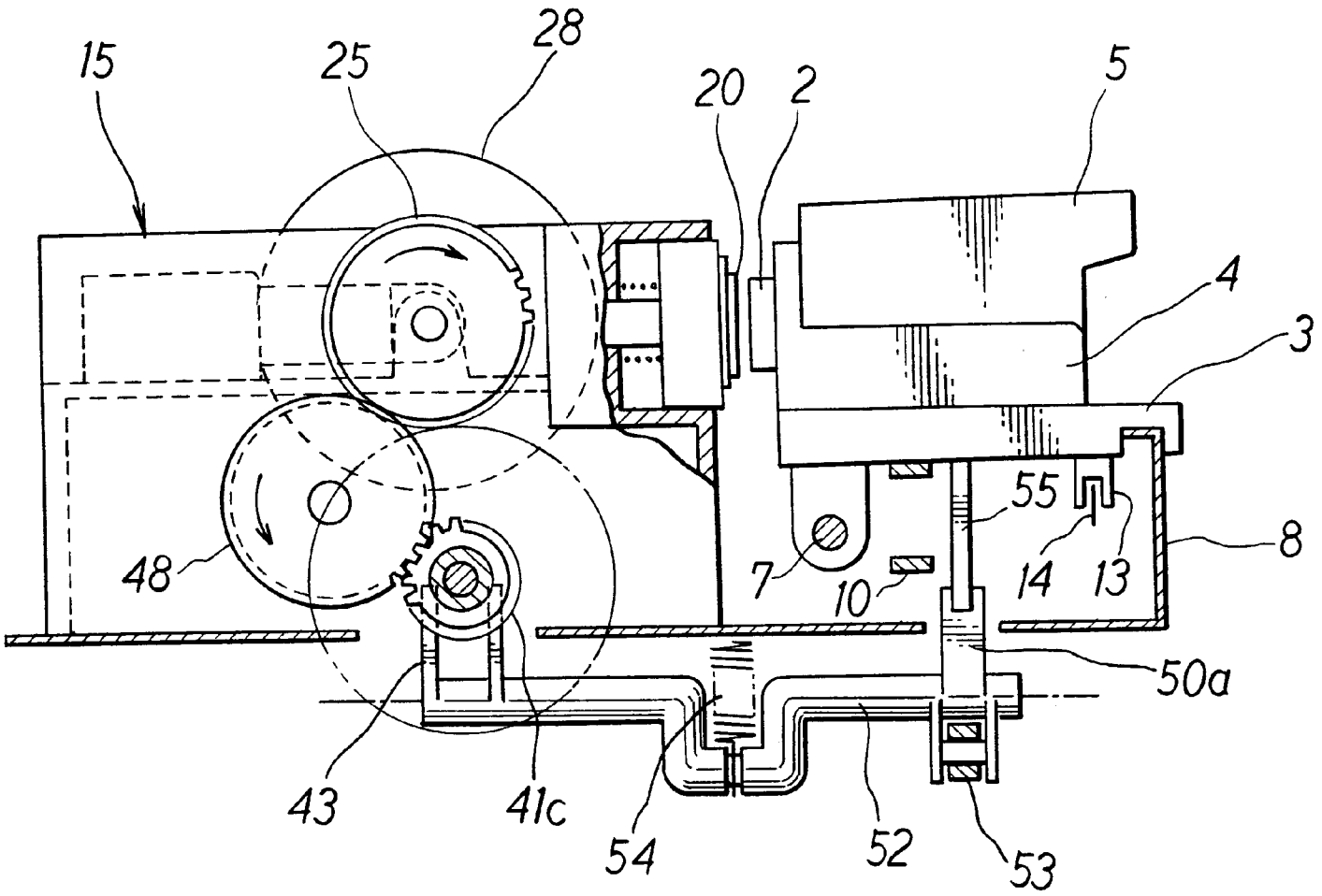
FIG. 2 is a side view partially in section showing the suction device and the carriage of the printer.

With reference to FIGS. 1 and 2, the print heads 2 are controlled by the timing production mechanism including an encoder 13 and an optical detector 14. The encoder 13 extends and has a number of indexes along the guide bar 8. The detector 14 is fixed to the carriage 3, and can read the indexes of the encoder 13. As the carriage 3 moves, the detector 14 outputs a signal, which causes a control circuit (not shown) to produce timing for controlling the heads 2. The print heads 2 face a sheet feeder 11, which includes a roller 11*a* having an axis in parallel with the guide rails 7 and 8. Fixed to one end of the roller 11*a* is a gear 12, to which the driving force of a line feed motor 40 (FIG. 3) can be transmitted. The feeder 11 can feed a sheet of paper P to a position in front of the heads 2.

A maintenance mechanism 15 is located at the side of the feeder 11. The maintenance mechanism 15 maintains the normal ink ejection from the print heads 2 and/or recovering them. The maintenance mechanism 15 includes a suction device 23 and protective caps 16. While the heads 2 are used, air bubbles may be produced in them, and/or ink droplets may stick to their ejection nozzles, causing defective ejection of ink. The suction device 23 can recover the heads 2 to their good ejecting condition by removing air bubbles and/or ink droplets. When the printer is not used, the caps 16 cover the nozzles to keep the inks from drying. Also when a print head 2 and/or an ink cartridge 5 are/is replaced, the suction device 23 is driven to supply ink from the cartridge 5 smoothly to the nozzles of the associated head 2. The ink sucked by the device 23 flows into a base 150, which contains foamed material for absorbing ink.

The carriage 3 can move between a printing area, where the print heads 2 face the sheet P in the feeder 11, and a maintenance area, where the heads 2 face the suction device 23 and protective caps 16 of the maintenance mechanism 15.

The protective caps 16 are mounted on a cap holder 16*a,* which is supported on a shaft or pin 17. The shaft 17 is parallel with the guide bars 7 and 8. The holder 16*a* can pivot and axially move on the shaft 17 so that the caps 16 move relative to the print heads 2 both around and along the shaft 17. As shown in FIGS. 6–10, the operating mechanism for controlling the caps 16 includes a lever 18, a cam 19 and a tension spring 20. The lever 18 protrudes from the outer end of the holder 16*a* into the path through which the carriage 3 moves. The cam 19 is fixed to the back of the holder 16*a.*

Figure 6:
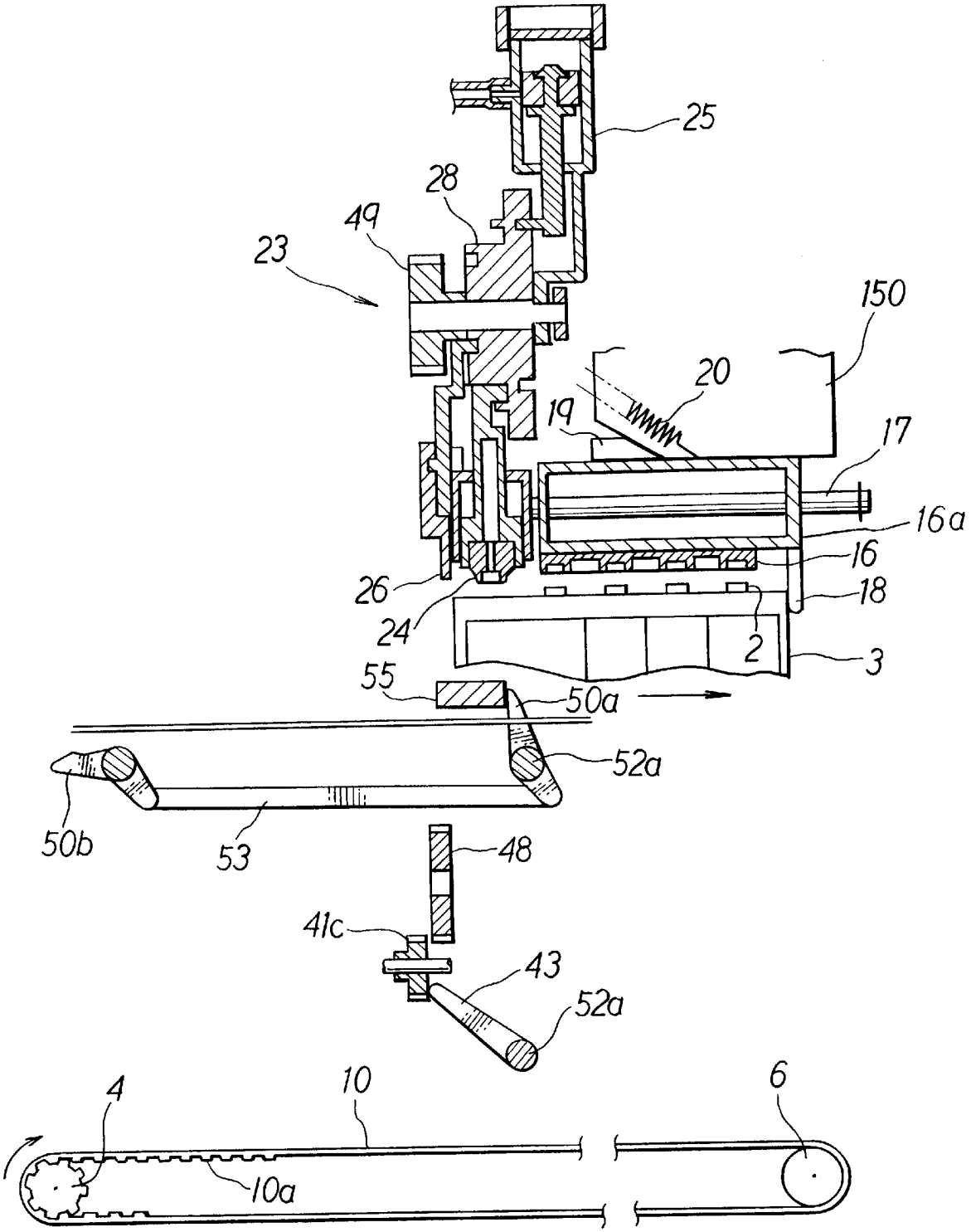
FIG. 6 is schematic view showing the operation of the maintenance mechanism of the printer wherein the carriage is moving into the maintenance area.

When the carriage 3 moves in the direction indicated by the arrow in FIG. 6, it pushes the lever 18, sliding the cap holder 16*a* in this direction. As the holder 16*a* slides, the cam 19 slides on the slope of the base 150, turning the holder 16*a* toward the print heads 2. As a result, the protective caps 16 cover the heads 2. The spring 20 urges the holder 16*a* away from the heads 2 and toward the printing area in the direction opposite to the arrow.

The suction device 23 includes a suction cap 24, a pump 25, a wiper 26 and a cam plate 28. The cap 24 can move into close contact with and away from one of the print heads 2. When the cap 24 is in close contact with one of the heads 2, the pump 25 develops negative pressure in the cap 24 in order to suck ink from the associated head 2. The wiper 26 can wipe the nozzle surfaces of the heads 2. The cam plate 28 can move the cap 24 and wiper 26 toward and away from the heads 2, and drive the pump 25.

Figure 3:
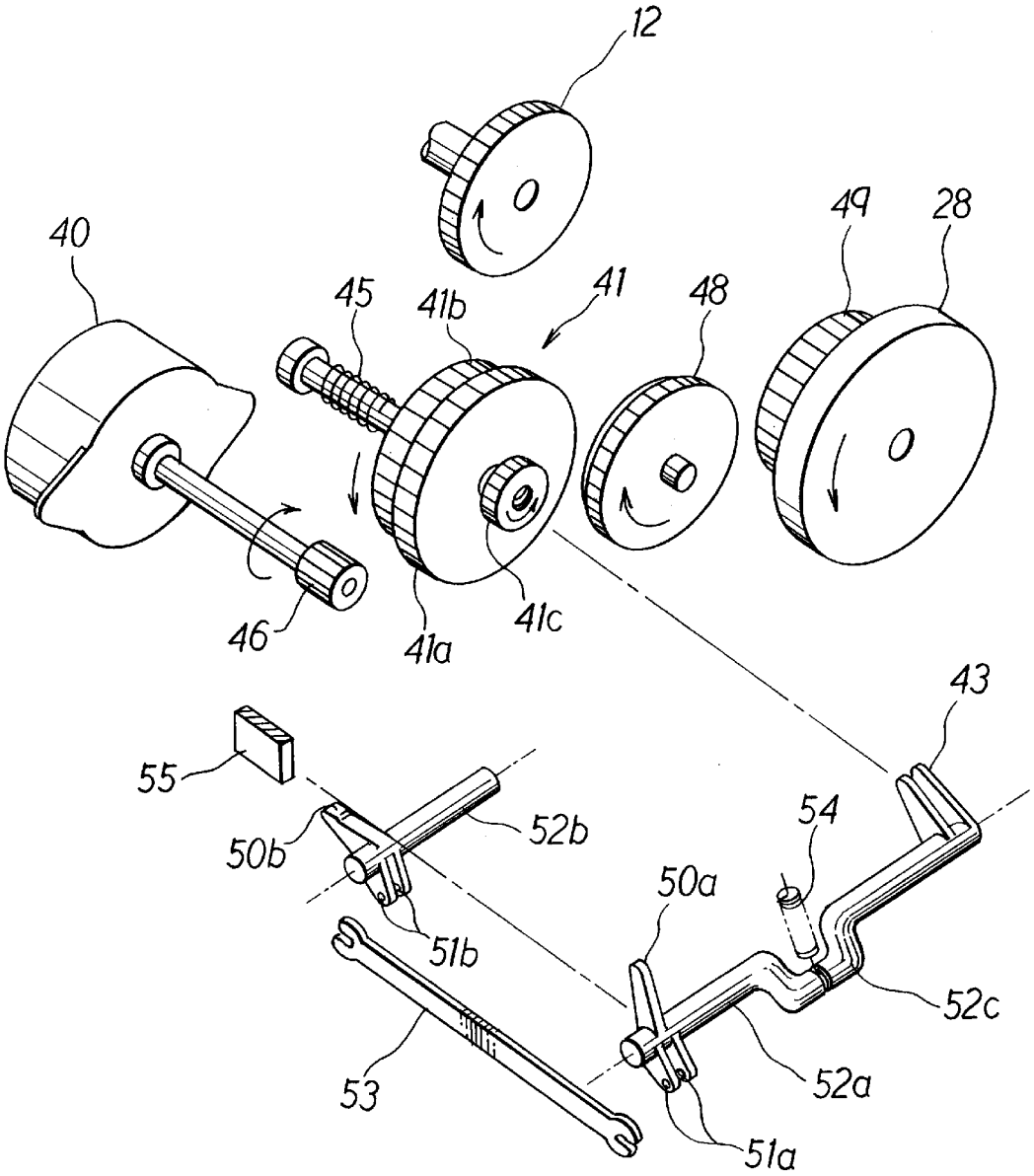
FIG. 3 is an exploded view showing the operating mechanism and the gearing for the suction device.

Used as the drive source for the cam plate 28 is the line feed motor 40. As shown in FIG. 3, a gear 46 is fixed to the output shaft of the motor 40. A stepped gear 41 includes a larger gear part 41*a,* a middle gear part 41*b* and a small gear part 41*c,* which are integral with each other. The larger gear part 41*a* is in mesh with the motor gear 46. The middle gear part 41*b* is in mesh with the gear 12 of the sheet feeder 11. The stepped gear 41 can slide axially, and is urged axially by a compression spring 45 to the position where the small gear part 41*c* meshes with a gear 48. This gear 48 is in mesh with a gear 49, which is fixed to the cam plate 28. An operating mechanism, which will be described later, can slide the stepped gear 41 against the urging force of the spring 45 to the position where the small gear part 41*c* disengages from the gear 48, thereby interrupting the transmission of the driving force to the suction device 23. The motor gear 46 and roller gear 12 keep meshing with the gear parts 41*a* and 41*b,* respectively, whichever position the stepped gear 41 is in.

Figure 4:
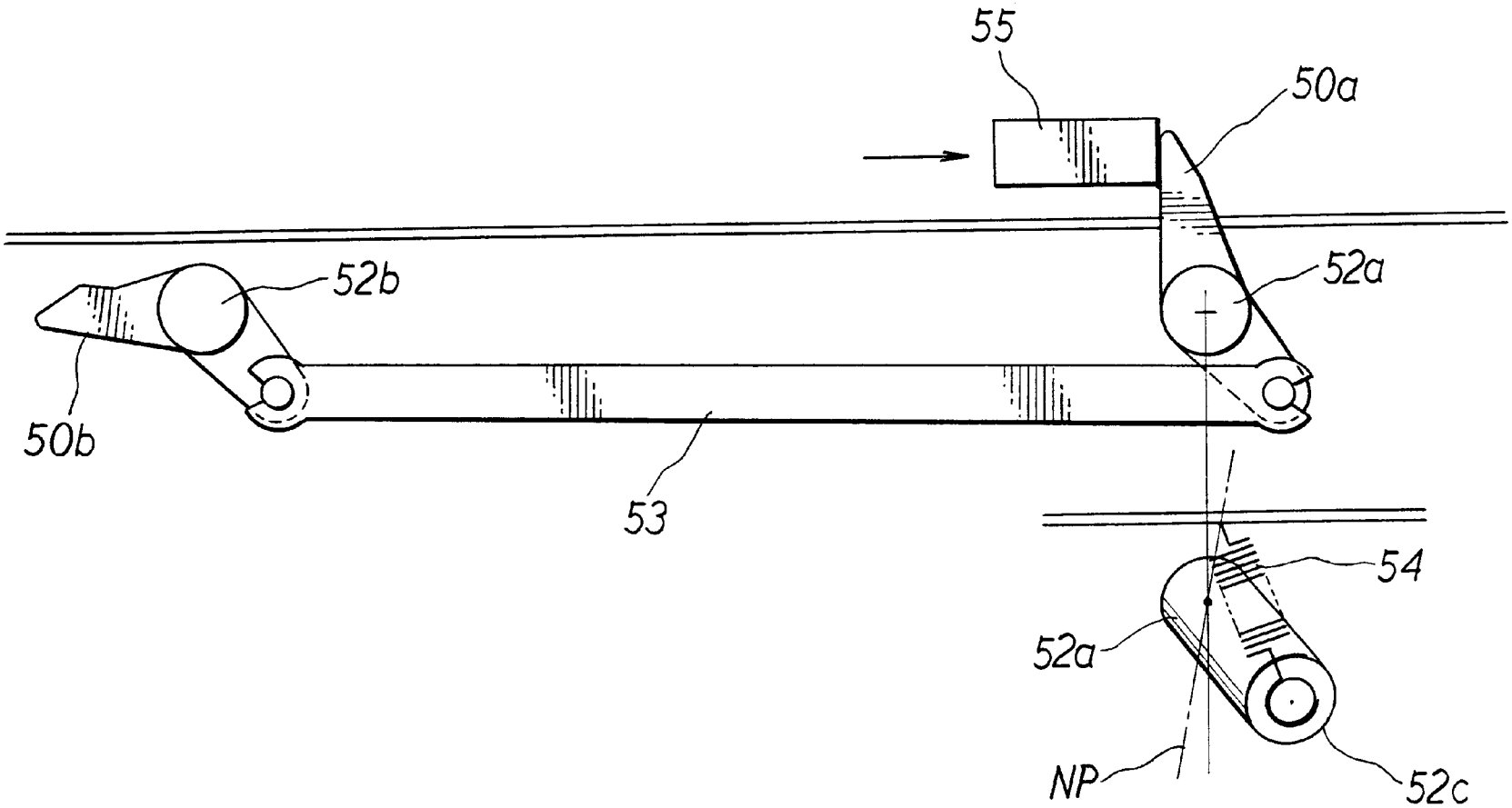
FIG. 4 is schematic view showing the operation of the operating mechanism for the suction device wherein the protrusion of the carriage pushes the driven lever 50*a* to transmit the driving force to the suction device.
Figure 5:
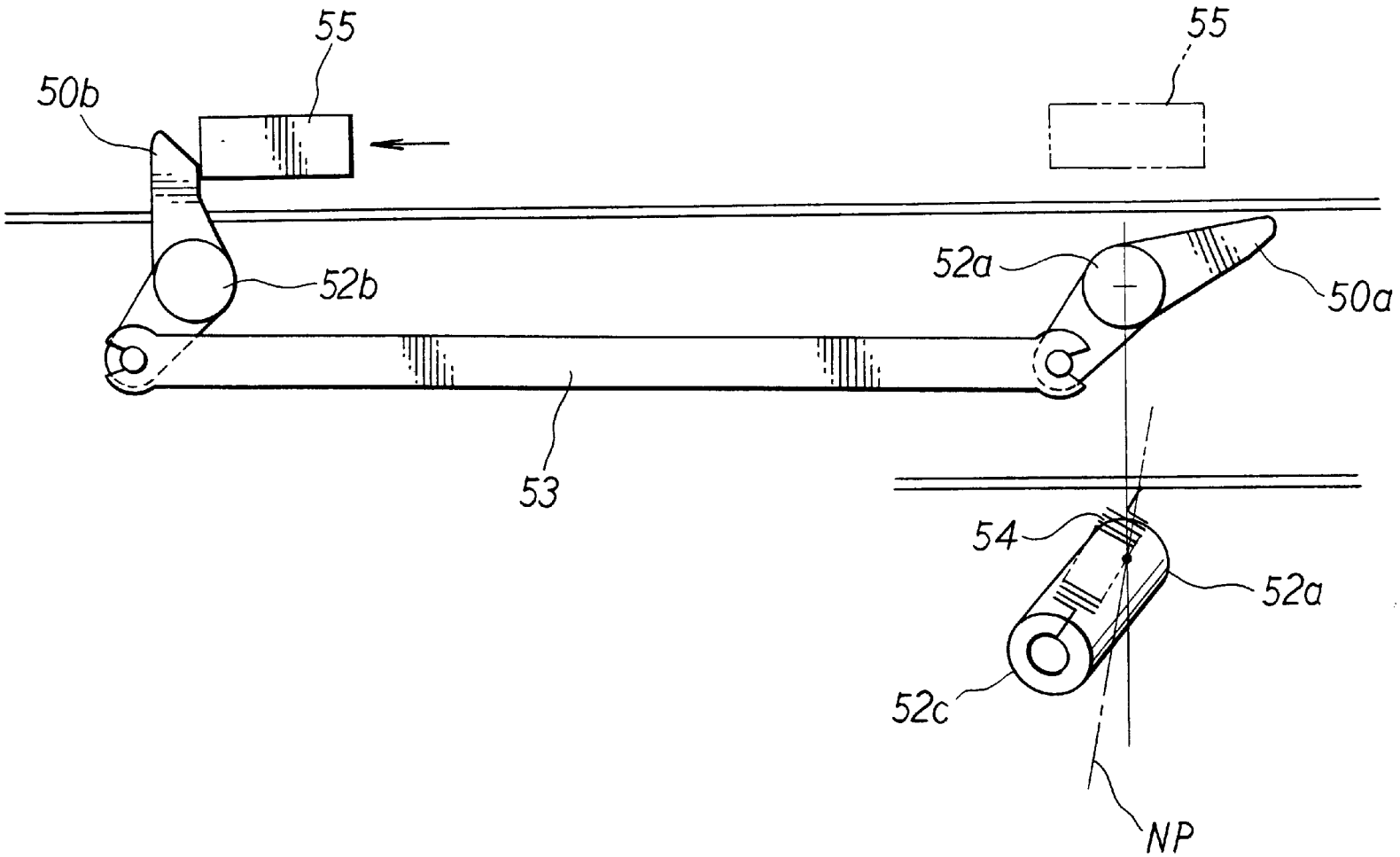
FIG. 5 is schematic view showing the operation of the operating mechanism for the suction device wherein the protrusion of the carriage pushes the driven lever 50*b* to transmit no driving force to the suction device.

As shown in FIGS. 2–5, the operating mechanism for the suction device 23 includes a pair of driven levers 50*a* and 50*b,* which are positioned between the guide bars 7 and 8. The levers 50*a* and 50*b* are fixed to the adjacent ends of horizontal parallel shafts 52*a* and 52*b,* respectively. The shafts 52*a* and 52*b* are substantially perpendicular to the directions in which the carriage 3 moves, and are supported rotatably. Also fixed to the shafts 52*a* and 52*b* are two pairs of arms 51*a* and 51*b,* respectively, which are linked together by a link 53. The link 53 extends perpendicularly to the shafts 52*a* and 52*b*. When, as shown in FIG. 4, the lever 50*a* stands or rises upright and protrudes into the path through which the carriage 3 moves, the other lever 50*b* falls or lies and retracts from the path. When, as shown in FIG. 5, the lever 50*a* falls, the other lever 50*b* stands.

Fixed to the other end of the shaft 52*a* is a pair of shift or operating levers 43 for sliding the stepped gear 41. When the driven lever 50*a* protrudes, the shift levers 43 push the gear 41 to disengage the small gear part 41*c* from the gear 48. When the lever 50*a* retracts, the levers 43 leave the gear 41 so that the spring 45 causes the gear part 41*c* to mesh with the gear 48. The shaft 52*a* includes an eccentric part 52*c*. A tension spring 54 is fitted between the eccentric part 52*c* and the printer frame, urging the shaft 52*a* in one of the alternative rotation directions. The shaft 52*a* can turn between the two positions shown in FIGS. 4 and 5, respectively. In each position, the driven lever 50*a* is erected or retracted, and stopped by a stopper (not shown). In each position, the eccentric shaft part 52*c* is positioned on one side of the neutral plane NP extending through the fixed end of the spring 54 and the axis of the shaft 52*a*. The spring 54 urges the stepped gear 41 through the shift levers 43 with greater force than the compression spring 45 urges the gear 41.

As best shown in FIG. 2, the carriage 3 includes a protrusion 55 on its bottom for pushing the driven levers 50*a* and 50*b* in their protruded positions.

Figure 7:
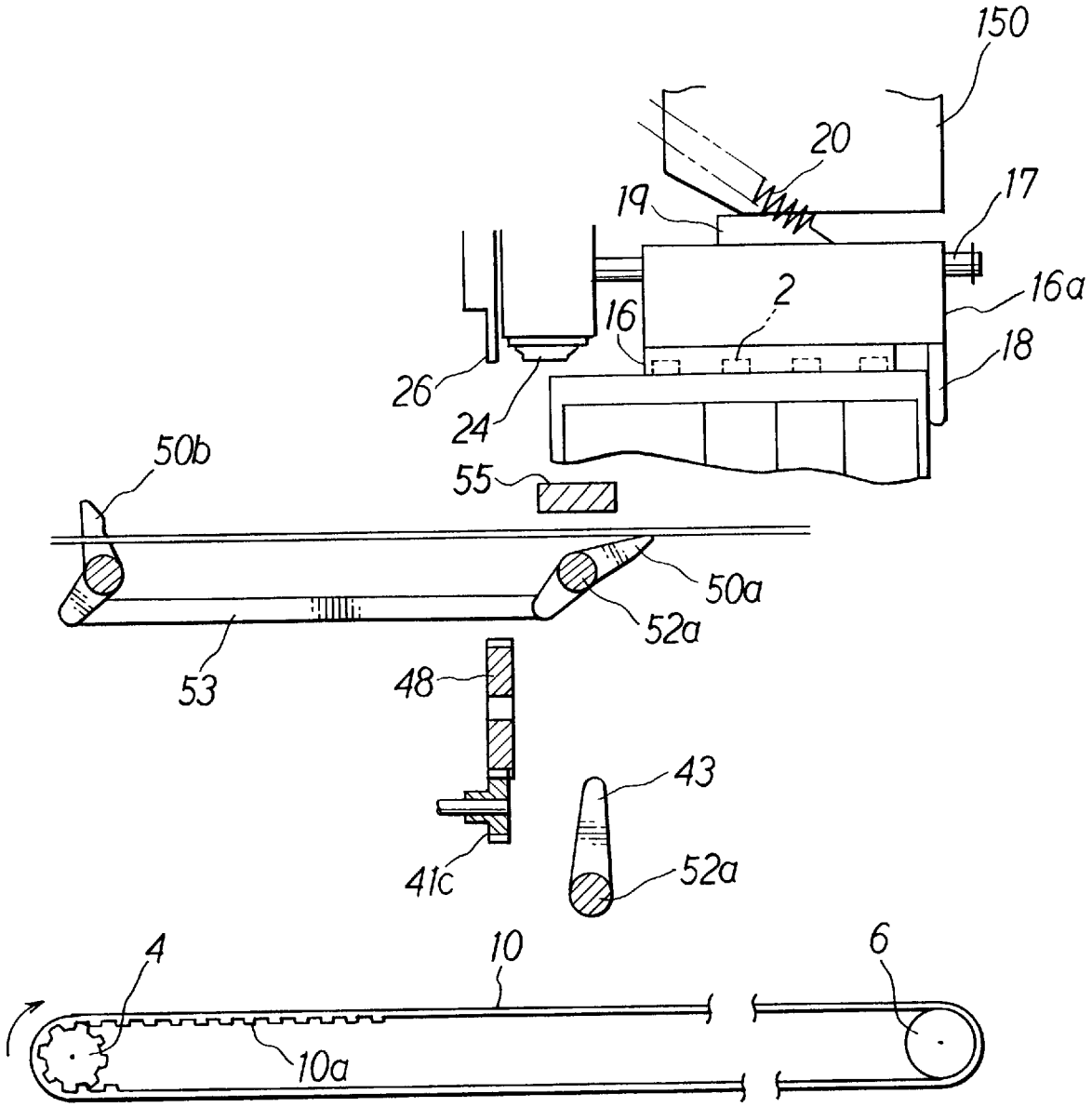
FIG. 7 is schematic view showing the operation of the maintenance mechanism of the printer wherein the ink jet head is covered by the protective caps.
Figure 8:
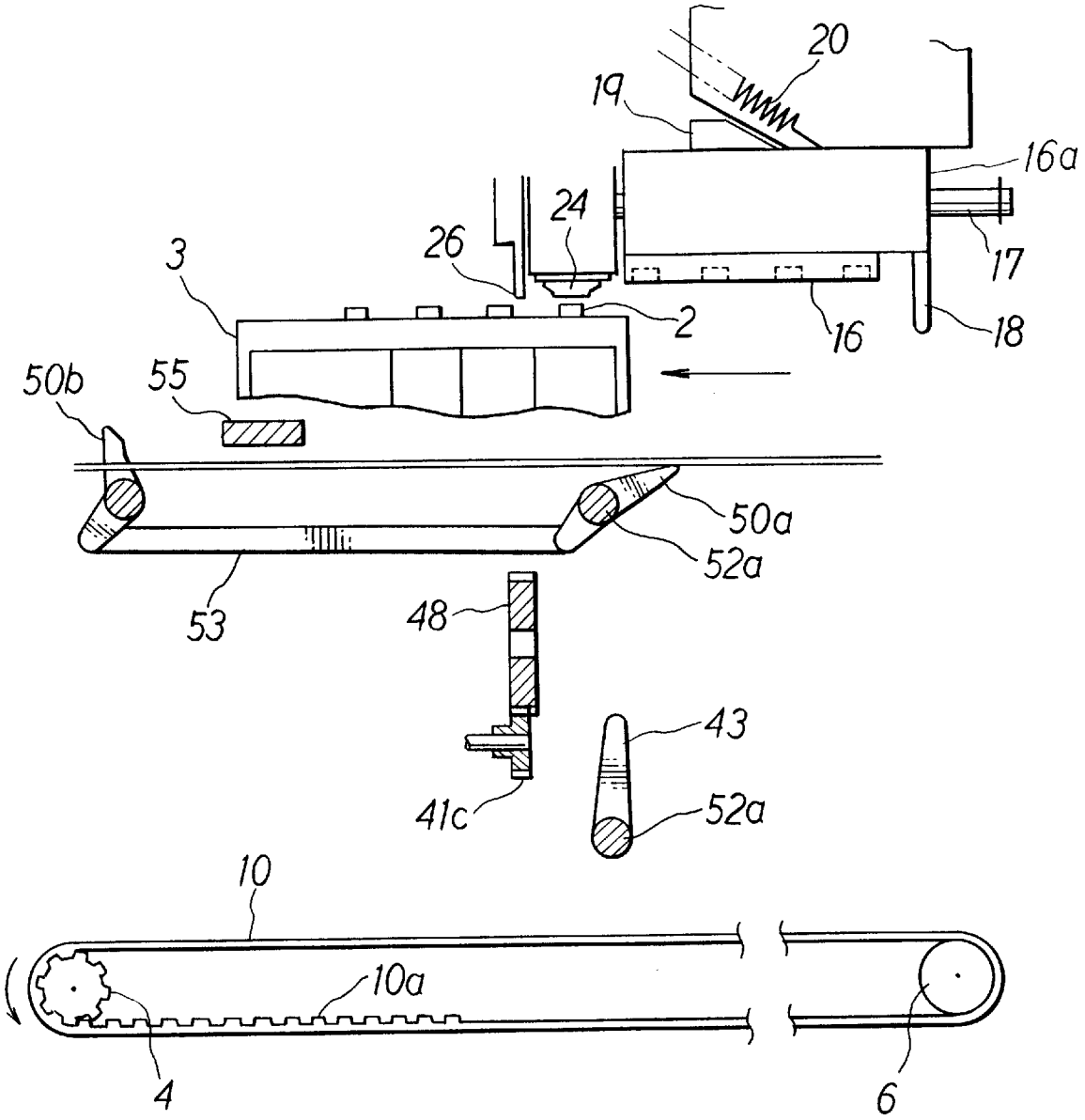
FIG. 8 is schematic view showing the operation of the maintenance mechanism of the printer wherein the ink jet head is moving out of the maintenance area.

In the maintenance area, the movement of the carriage 3 in the direction indicated in FIG. 6 slides the cap holder 16*a* against the force of the spring 20 by pushing the lever 18 fixed to the holder 16*a*. In this area, the movement of the carriage 3 operates the suction device 23 by pushing the driven lever 50*a* or 50*b* against the force of the spring 54. Consequently, greater loads are applied to the carriage 3 in the maintenance area. Therefore, as shown in FIGS. 6–8, the carriage drive belt 10 consists of a flat part and a toothed part, which has teeth 10*a* for meshing with the driving pulley 4 only when the carriage 3 is positioned in the maintenance area.

Figure 11:
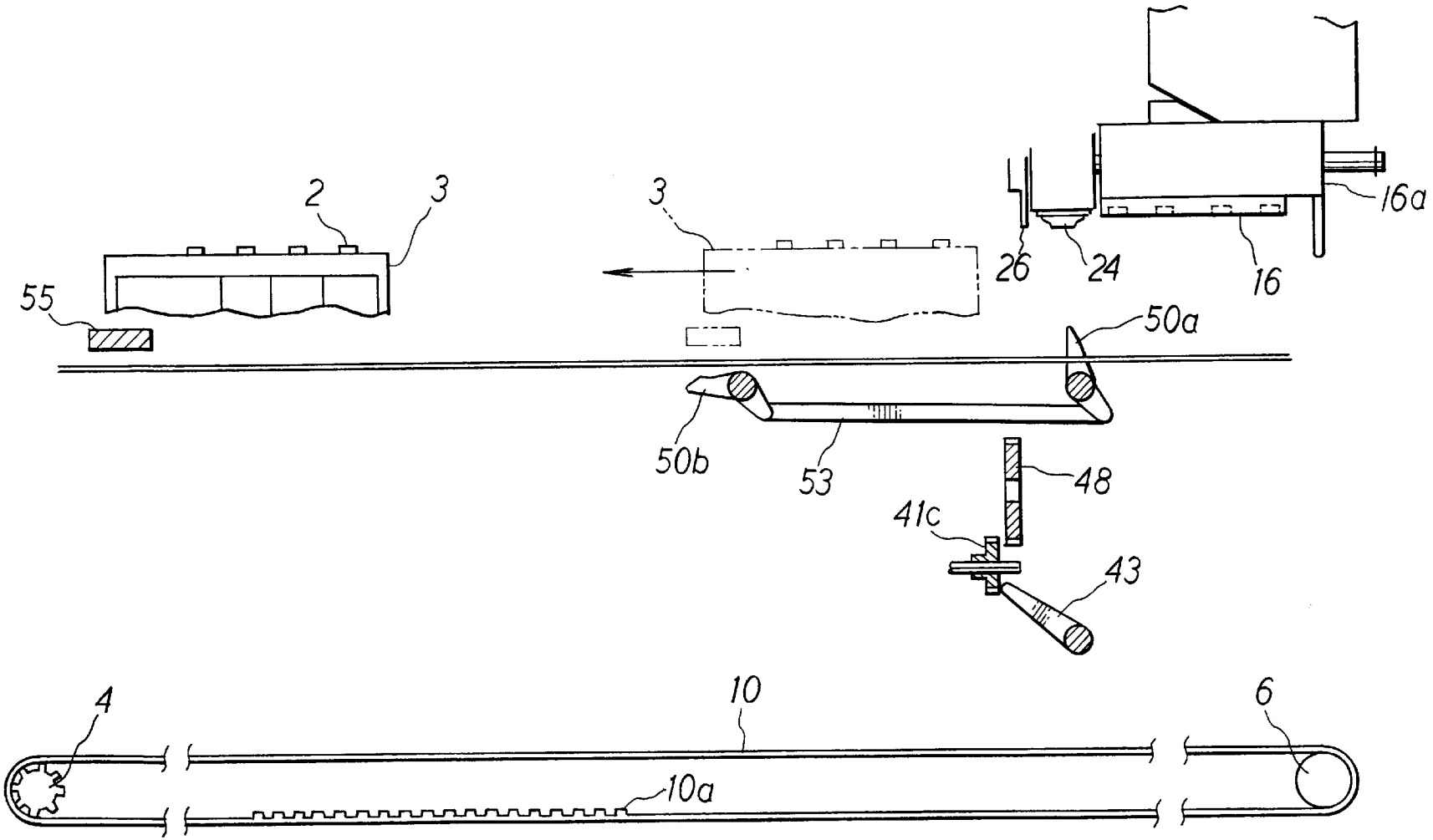
FIG. 11 is a schematic view showing the relationship established between each of the driving and driven pulleys and the belt when the heads are positioned in the printing area in front of a sheet of paper.

When the print heads 2 are positioned in the printing area in front of the sheet P in the feeder 11, as shown in FIG. 11, the pulleys 4 and 6 are in engagement with the flat part of the belt 10. In this area, the heads 2 are reciprocated only with the friction between the driving pulley 4 and the belt 10. Even if the pulley 4 slips a little on the belt 10, the printing operation is accurate because the timing for controlling the heads 2 is produced on the basis of the encoder 13. In this area, because the belt teeth 10*a* and the teeth of the pulley 4 do not interfere, no such interference causes vibration, which would (otherwise) affect the printing operation.

When the carriage 3 moves from the maintenance area to the printing area, as shown in FIG. 11, its bottom protrusion 55 pushes and tips over the driven lever 50*b*. This causes the shift levers 43 to disengage the small gear part 41*c* from the gear 48. When the carriage 3 is in this area, the tension of the spring 54 keeps the gear part 41*c* disengaged from the gear 48. Consequently, even when the feed motor 40 rotates, no driving force is transmitted to the suction device 23. The spring 54 also keeps the driven levers 50*a* and 50*b* erected and retracted, respectively.

When the carriage 3 moves from the printing area to the maintenance area after printing or in order to suck ink from one of the print heads 2, as shown in FIG. 6, the belt teeth 10*a* start to mesh with the driving pulley 4. In the meantime, the carriage protrusion 55 pushes and tips over the driven lever 50*a,* as shown in FIGS. 6 and 7. This causes the small gear part 41*c* to mesh with the gear 48.

This movement of the carriage 3 pushes the lever 18 of the cap holder 16*a,* sliding the holder 16*a* along the shaft 17. The slide movement of the holder 16*a* slides the cam 19 on the slope of the base 150, thereby turning the holder 16*a* toward the print heads 2 until the caps 16 contact them closely as shown in FIG. 7. The heads 2 are kept covered with the caps 16 until printing starts.

If it is commanded that ink be sucked from one of the print heads 2, however, the carriage 3 is moved from the position shown in FIG. 7 toward the printing area until the appropriate head 2 faces the suction cap 24, as shown in FIG. 8. This movement of the carriage 3 allows the tension of the spring 20 to turn the cap holder 16*a* away from the heads 2, and to move the holder 16*a* toward the suction device 23, back to the position shown in FIGS. 6 and 8.

Figure 9A:
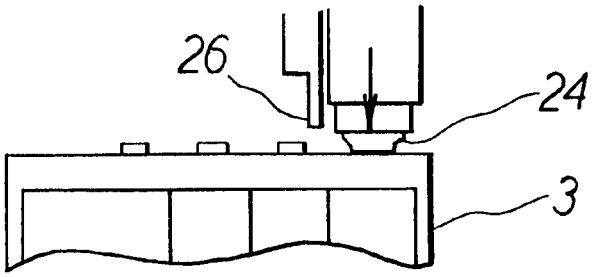
FIG. 9A is a fragmentary view showing the suction cap of the printer being brought into close contact with one of the print heads by the turning of the cam plate.
Figure 9B:
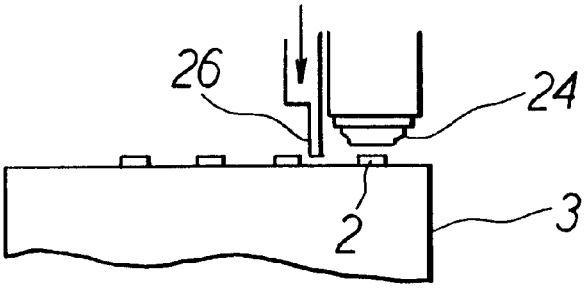
FIG. 9B is a fragmentary view showing the suction cap being retracted and the wiper being protruded by further turning of the cam plate.
Figure 9C:
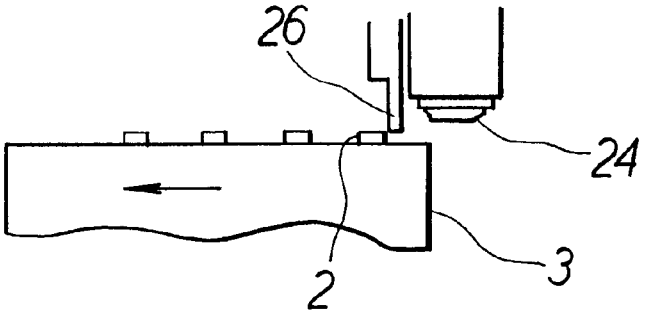
FIG. 9C is a fragmentary view showing the wiper wiping the nozzle surface of the head.

When, as stated above, the driven lever 50*a* is tipped over, the shift levers 43 are moved away from the stepped gear 41. As a result, the gear part 41*c* is engaged with the gear 48 by the compression of the spring 45. Therefore, the rotation of the feed motor 40 turns the cam plate 28. As shown in FIG. 9A, the turning of the cam plate 28 moves the suction cap 24 into close contact with the print head 2 facing the cap 24. Then, the pump 25 is driven to suck ink from the head 2. Subsequently, as shown in FIG. 9B, the cap 24 retracts, and the wiper 26 moves forward. With the wiper 26 protruded, as shown in FIG. 9C, the carriage 3 is moved toward the printing area so that the wiper 26 wipes the nozzle surface of the head 2. This removes the ink remaining on the nozzle surface after the suction.

Figure 10:
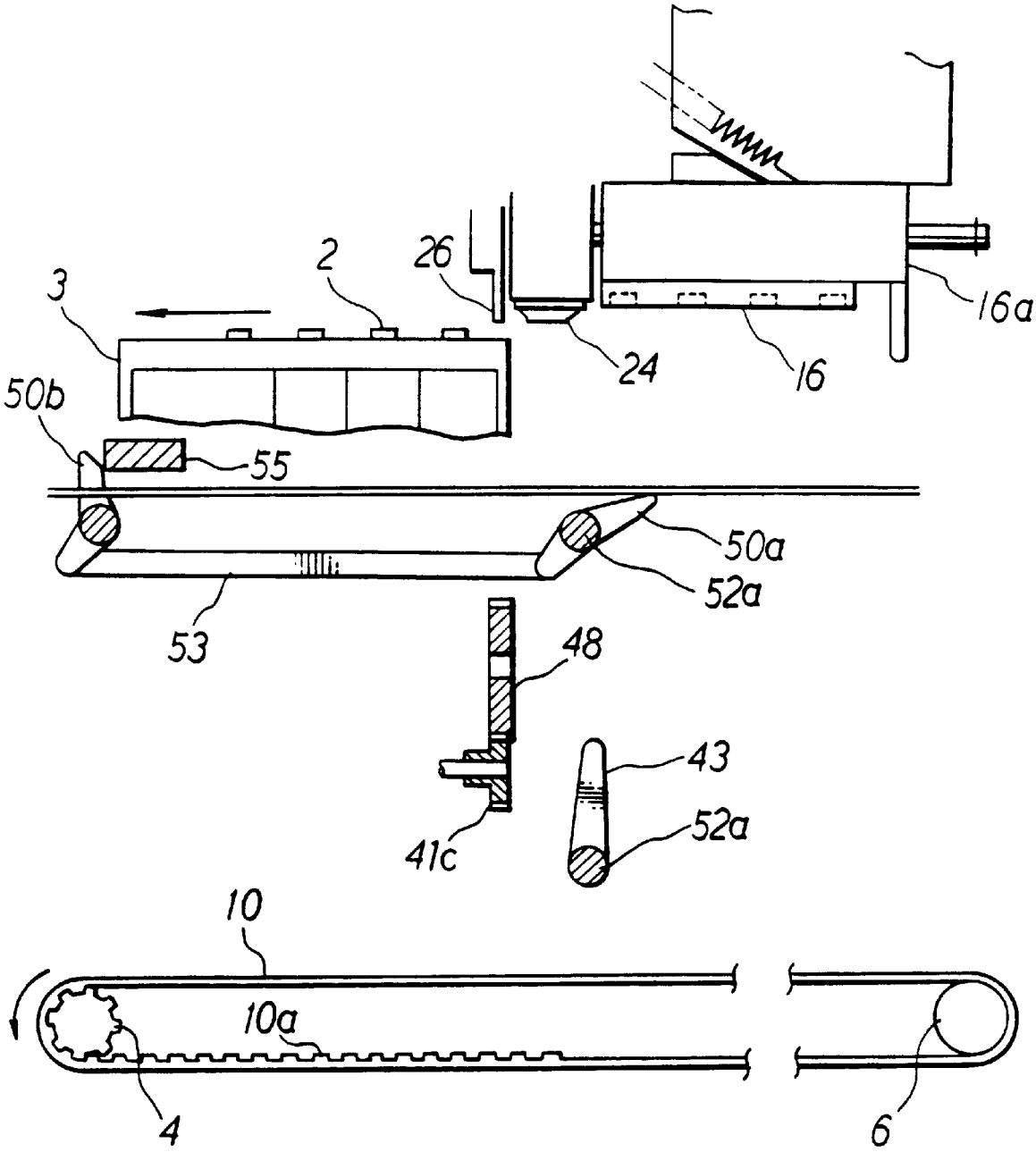
FIG. 10 is a schematic view showing the heads returning to the printing area after maintenance.

While, as shown in FIG. 10, the carriage 3 is further moved toward the printing area in order to return to this area, the carriage protrusion 55 pushes and tips over the driven lever 50*b*. As a result, as shown in FIG. 11, the other driven lever 50*a* stands again, and the small gear part 41*c* leaves the gear 48.

After the carriage 3 starts to tip over the driven lever 50*a* or to push the lever 18 of the cap holder 16*a* and until it tips over the other driven lever 50*b,* as stated above, the belt teeth 10*a* mesh with the driving pulley 4. Consequently, the pulley 4 can drive the belt 10 without slipping in a high load condition.

Although an ink jet printer according to the invention has been described by way of preferred embodiment, the invention is not limited to the embodiment, but may include improvements and modifications or variations which can be thought of by those skilled in the art. The printer of the invention should be interpreted or construed within the scope of the appended claims and their equivalents thereof. For example, the condition that the belt teeth mesh with the toothed pulley may apply to, not only the case where the carriage engages with the operating device for the maintenance mechanism, but also any other case where a load is applied to the driving system for moving the carriage. For example, relatively high loads are applied at both ends of the printing area, where the cartridge changes its traveling direction. Therefore, the belt may be so adapted that the belt teeth mesh with the toothed pulley when the carriage is positioned at the ends of the printing area. In other words, the belt may have teeth which mesh with the toothed pulley only when higher loads are applied through the driving system for the carriage to the belt than during printing. As a result, the driving force necessary for mechanically operating the maintenance mechanism can be compatible with quiet high-quality printing.

The operating device for the maintenance mechanism is not limited to levers, but may be any other members or of any other structure. The maintenance mechanism of the embodiment is driven by the feed motor for driving the sheet feeder, but might be driven by another motor. The maintenance mechanism of the embodiment includes protective caps, a suction device and a wiper. The maintenance mechanism of the invention may, however, include only protective caps, a suction device or a wiper, or a combination of some of them. The printer of the invention may include an apparatus which is a combination of a suction device and protective caps.

What is claimed is:

1. An ink jet printer comprising:

a print head for ejecting droplets of ink onto a printing medium;

a carriage on which the head is mounted; and a driving system for moving the carriage, the driving system including a toothed driving pulley, a cylindrical driven pulley and an endless belt engaged thereof, the carriage being fixed to the endless belt, only part of the belt having teeth for meshing with the toothed driving pulley;

different loads being applied to the driving system when the carriage moves in different areas between the toothed driving pulley and the cylindrical driven pulley, the toothed driving pulley meshing with the belt teeth only when the carriage moves in an area where a high load is applied to the driving system.

2. An ink jet printer according to claim 1, farther comprising;

a maintenance mechanism for at least one of a maintenance and recovery of an ink ejection operation of the print head; and an operating system for operating the maintenance mechanism with the driving system by engaging the carriage with the operating system;

the high load being applied to the driving system when the carriage engages with the operating system.

3. An ink jet printer according to claim 2, wherein a load is applied to the driving system when the carriage moves in a printing area, where the print head prints the printing medium, the load applied to the driving system in the printing area being lower than the high load applied when the carriage engages with the operating system.

4. An ink jet printer according to claim 2, wherein the maintenance mechanism includes a suction device for sucking the ink from the print head, the operating system includes a pair of driven levers, which protrude into a path of the carriage in order to be pushed by the carriage.

5. An ink jet printer according to claim 4, and further comprising:

a pair of rotatable shafts, to each of which one of the driven levers is fixed;

the levers being pivotable into and out of the path of the carriage, the levers being linked together by a link so that, when one of the levers is tipped over from the path, the other lever is protruded into the path.

6. An ink jet printer according to claim 5, wherein the carriage pushes over one of the driven levers when the carriage enters the maintenance area, where the carriage faces the maintenance mechanism, the carriage tipping over the other lever when the carriage leaves the maintenance area.

7. An ink jet printer according to claim 6, and further comprising:

a motor;

a transmission gear coupled to the motor;

an intermediate gear;

an urging member urging the transmission gear into engagement with the intermediate gear;

a cam plate coupled to the intermediate gear for driving the suction device; and an operating lever fixed to the rotatable shaft to which one of the driven levers is fixed, the operating lever turning in a direction to disengage the transmission gear from the intermediate gear against a force of the urging member when the carriage tips over one of the driven levers.

8. An ink jet printer according to claim 7, wherein the operating lever turns in an opposite direction so that the urging member engages the transmission gear with the intermediate gear when the carriage tips over the other driven lever.

9. An ink jet printer according to claim 4, wherein the maintenance mechanism further includes a protective cap for closely contacting the print head in order to prevent the nozzles of the head from drying, the operating system further including another lever connected to the cap, said another lever protruding into the path of the carriage in order to be pushed by the carriage, an urging member urging the cap away from the head, and a cam for moving the cap toward the head against the force of the urging member when said another lever is pushed to slide the cap together with the carriage.

10. An ink jet printer according to claim 1, and further comprising an encoder having indexes along a guide bar, and a detector mounted on the carriage for reading the indexes in order to generate a signal, which is the basis for controlling a position of the print head.

11. An ink jet printer comprising:

a print head for ejecting droplets of ink onto a printing medium;

a maintenance mechanism for at least one of a maintenance and recovery of an ink ejection operation of the head;

a carriage for moving in and between a printing area and a maintenance area, where the carriage faces the maintenance mechanism, the head being mounted on the carriage;

a driving system for moving the carriage, the system including a toothed driving pulley, a cylindrical driven pulley and an endless belt which runs between the pulleys and to which the carriage is fixed, the belt including a flat part and a toothed part for meshing with the toothed pulley;

an operating system for operating the maintenance mechanism with the driving system by engaging the carriage with the operating system;

the belt being in such engagement with the toothed pulley that, when the carriage engages with the operating system, the toothed pulley meshes with the toothed part of the belt.

12. An ink jet printer according to claim 11, wherein the toothed pulley engages with the flat part of the belt when the carriage is positioned in the printing area.

13. An ink jet printer according to claim 11, wherein a load is applied to the toothed pulley by the carriage engaging with the operating system.

14. An ink jet printer according to claim 11, wherein the maintenance mechanism includes a suction device for sucking the ink from the print head, the operating system includes a pair of driven levers, which protrude into a path of the carriage in order to be pushed by the carriage.

15. An ink jet printer according to claim 14, and further comprising:

a pair of rotatable shafts, to each of which one of the driven levers is fixed;

the levers being pivotable into and out of the path of the carriage, the levers being linked together by a link so that, when one of the levers is tipped over from the path, the other lever is protruded into the path.

16. An ink jet printer according to claim 15, wherein the carriage pushes over one of the driven levers when the carriage enters the maintenance area, where the carriage faces the maintenance mechanism, the carriage tipping over the other lever when the carriage leaves the maintenance area.

17. An ink jet printer according to claim 16, and further comprising:

a motor;

a transmission gear coupled to the motor;

an intermediate gear;

an urging member urging the transmission gear into engagement with the intermediate gear;

a cam plate coupled to the intermediate gear for driving the suction device; and an operating lever fixed to the rotatable shaft to which one of the driven levers is fixed, the operating lever turning in a direction to disengage the transmission gear from the intermediate gear against a force of the urging member when the carriage tips over one of the driven levers.

18. An ink jet printer according to claim 17, wherein the operating lever turns in an opposite direction so that the urging member engages the transmission gear with the intermediate gear when the carriage tips over the other driven lever.

19. An ink jet printer according to claim 17, wherein the maintenance mechanism further includes a wiper for wiping a nozzle surface of the print head, the cam plate driving the wiper.

20. An ink jet printer according to claim 14, wherein the maintenance mechanism further includes a protective cap for closely contacting the print head in order to prevent the nozzles of the head from drying, the operating system further including another lever connected to the cap, said another lever protruding into the path of the carriage in order to be pushed by the carriage, an urging member urging the cap away from the head, and a cam for moving the cap toward the head against the force of the urging member when said another lever is pushed to slide the cap together with the carriage.

21. An ink jet printer according to claim 11, wherein the maintenance mechanism further includes a protective cap for closely contacting the print head in order to prevent nozzles of the head from drying, the operating system further including another lever connected to the cap, said another lever protruding into the path of the carriage in order to be pushed by the carriage, an urging member urging the cap away from the head, and a cam for moving the cap toward the head against the force of the urging member when said another lever is pushed to slide the cap together with the carriage.

22. An ink jet printer according to claim 11, and further comprising an encoder having indexes along the path of the carriage, and a detector mounted on the carriage for reading the indexes in order to generate a signal, which is the basis for controlling a position of the print head.

* * * * *